United States Patent [19]

Yamaguchi

[11] Patent Number: 4,483,775

[45] **Date of Patent: * Nov. 20, 1984**

[54] LUBRICATING OIL COMPOSITIONS CONTAINING OVERBASED CALCIUM SULFONATES

[75] Inventor: Elaine S. Yamaguchi, El Cerrito, Calif.

[73] Assignee: Chevron Research Company, San Francisco, Calif.

[ * ] Notice: The portion of the term of this patent subsequent to Dec. 22, 1998 has been disclaimed.

[21] Appl. No.: 437,371

[22] Filed: Oct. 28, 1982

[51] Int. Cl.[3] ..... C10M 1/48

[52] U.S. Cl. ..... 252/32.7 E; 252/46.7; 252/389 A; 252/400 A

[58] Field of Search ..... 252/32.7 E, 46.7

[56] References Cited

U.S. PATENT DOCUMENTS

| | | | |
|---|---|---|---|
| 3,185,645 | 5/1965 | Clayton | 252/32.7 E |
| 3,284,354 | 11/1966 | Tinkel et al. | 252/32.7 E |
| 3,844,960 | 10/1974 | Breitigan et al. | 252/32.7 E |
| 4,306,984 | 12/1981 | Yamaguchi | 252/32.7 E |

*Primary Examiner*—Jacqueline V. Howard

*Attorney, Agent, or Firm*—J. A. Buchanan, Jr.; D. A. Newell; V. J. Cavalieri

[57] ABSTRACT

The anti-wear properties of lubricating oil compositions containing overbased calcium sulfonate are improved when a metal diisopropyl dithiophosphate-succinimide complex is added to the oil. Oil compositions containing this combination are useful as crankcase lubricants.

13 Claims, No Drawings

LUBRICATING OIL COMPOSITIONS CONTAINING OVERBASED CALCIUM SULFONATES

BACKGROUND OF THE INVENTION

1. Field of the Invention

This invention relates to a lubricating oil composition which reduces wear between relatively moving surfaces while providing protection, concomitantly from sludge formation and corrosion.

2. Description of the Prior Art

A balanced formulated lubricating oil for use in an internal combustion engine normally contains additives which will protect against wear, act as antioxidants, corrosion inhibitors and detergent-dispersants.

In the past many hydrocarbyl dithiophosphate compounds have been employed as additives in lubricant compositions primarily to reduce wear and to act as antioxidants. Of the many compounds employed, perhaps the best known are zinc salts of 0,0'-dihydrocarbyl dithiophosphoric acids.

Also, since lubricating oils tend to deteriorate under conditions of use in the present day automobile engine, with the attendant formation of sludge, lacquer and resinous materials, it is common to add agents which are known in the art as detergents, dispersants or detergent-dispersants. Overbased metal hydrocarbyl sulfonates are particularly useful in this respect. These agents are believed to be effective because they provide alkalinity capable of neutralizing strong organic and inorganic acids and are capable of dispersing deposits and deposit precursors into the oil phase.

It has been found, however, that lubricating oils containing overbased calcium hydrocarbyl sulfonates tend to offset the effectiveness of the normal metal salts of dihydrocarbyl dithiophosphoric acids to provide sufficient wear protection in the internal combustion engine of an automobile. This is an especially bad situation at this time since automobile manufacturers are seeking to use lower levels of metal salts of dihydrocarbyl dithiophosphoric acids in lubricating oils in order to protect against deterioration in performance of the emissions control system—both catalyst poisoning and oxygen sensor contamination are involved.

SUMMARY OF THE INVENTION

It has now been found that this detrimental effect of the overbased calcium hydrocarbyl sulfonates on wear of metal parts in the internal combustion engine can be overcome by adding to a lubricating oil containing these materials an effective amount to reduce wear of a complex prepared by reacting at about 25° C. to 180° C.:

(a) an insoluble metal salt of a diisopropyl dithiophosphoric acid of the formula

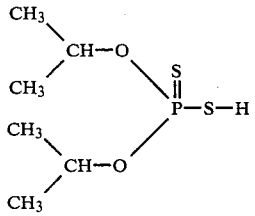

wherein the metal of said metal salt being a Group I metal, a Group II metal, aluminum, tin, cobalt, lead, molybdenum, manganese or nickel; with (b) an oil soluble alkenyl or alkyl mono- or bis-succinimide of the formula

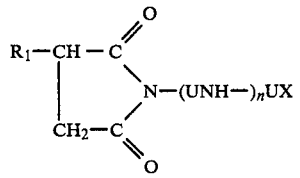

wherein X is amino or a group of the formula

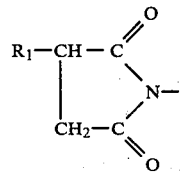

$R_1$ is an alkenyl or alkyl group containing from about 20 to 300 carbon atoms, U is alkylene containing 2 to 6 carbon atoms, n is an integer of from 0 to 6;

wherein the weight of ratio of (b) to (a) is at least in the range of from 3:1 to 10:1, preferably 4:1 to 5:1.

DETAILED DESCRIPTION

The oil soluble complexes prepared from a metal diisopropyl dithiophosphate and alkenyl or alkyl mono- or bis-succinimide useful in the present invention, are described in U.S. Pat. No. 4,306,984 of common inventive entity and assignee to this application, the disclosure of which is incorporated totally herein by reference.

The complex, the exact structure of which is not known, may be formed by reacting the metal diisopropyl dithiophosphate and the succinimide together neat at a temperature above the melting point of the mixture of reactants and below the decomposition temperature, or in a diluent in which both reactants are soluble. For example, the reactants may be combined in the proper ratio and heated together to form a homogeneous product which may be added to the oil or the reactants may be combined in the proper ratio in a solvent such as toluene or chloroform, the solvent stripped off, and the complex thus formed may be added to the oil.

The diluent is preferably inert to the reactants and products formed and is used in an amount sufficient to insure solubility of the reactants and to enable the mixture to be efficiently stirred.

Temperatures for preparing the complex may be in the range of from 25° C. to 180° C. and preferably 130° C. to 145° C. depending on whether the complex is prepared neat or in a diluent, i.e., lower temperatures may be used when a solvent is used. Since the metal diisopropyl dithiophosphates are essentially insoluble in oil, the complex may not be made in-situ in the oil, e.g, addition of the insoluble diisopropyl dithiophosphate to an oil containing the appropriate ratio of a succinimide does not solubilize the dithiophosphate, thus rendering it ineffective as an anti-wear agent.

Weight percent ratios of alkenyl or alkyl mono- or bis-succinimides to metal diisopropyl dithiophosphate in the complex in the range of 3:1 to 10:1 and preferably from 4:1 to 5:1 should be maintained. Lesser amounts of the succinimide will result in haziness and precipitation of the metal diisopropyl dithiophosphates.

The metal diisopropyl dithiophosphates useful in preparing the oil soluble complexes may be represented generally by the formula:

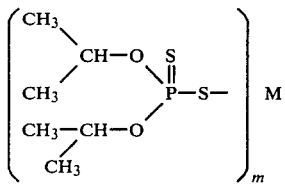

wherein M is a Group I metal, a Group II metal, aluminum, tin, cobalt, lead, molybdenum, manganese or nickel, and m is an integer which is equal to the valence of the metal M.

These compounds can be prepared by the reaction of isopropyl alcohol with phosphorus pentasulfide followed by reaction with the appropriate metal compound. Methods to prepare these compounds are described in U.S. Pat. Nos. 3,089,850, 3,102,096, 3,293,181 and 3,489,682 and the disclosure thereof are incorporated herein by reference.

The metal salts which are useful in this invention include those salts containing metals selected from the class consisting of Group I metals, Group II metals, aluminum, lead, tin, molybdenum, manganese, cobalt, and nickel. Examples of metal compounds which may be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, nickel carbonate, molybdenum oxide, and molybdenum oxysulfide.

The oil soluble alkenyl or alkyl mono- or bis-succinimides which are employed in preparing the oil soluble complexes are generally known as lubricating oil dispersants and are described in U.S. Pat. Nos. 992,708, 3,018,291, 3,024,237, 3,100,673, 3,219,666, 3,172,892 and 3,272,746, the disclosure of which are incorporated by reference. These materials are prepared by reacting an alkenyl or alkyl-substituted succinic anhydride of the formula:

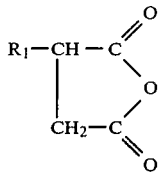

wherein $R_1$ is defined above, with a polyalkylenepolyamine of the formula:

$$H_2N—UNH_nUNH_2$$

wherein U and n are defined above.

The alkylene group designated by U, which contains from 2 to 6 carbon atoms, may be straight chain or branched, but will usually be straight chained. Illustrative alkylene groups are ethylene, propylene, 1,2-propylene, tetramethylene, hexamethylene, etc. The preferred alkylene groups are from two to three carbon atoms, there being two carbon atoms between the nitrogen atoms.

Non-limiting examples of suitable amine compounds include: 1,2-diaminoethane; 1,3-diaminopropane; 1,4-diaminobutane; 1,6-diaminohexane; diethylene triamine; triethylene tetramine, tetraethylene pentamine; 1,2-propylene diamine; and the like.

A product comprising predominantly mono- or bis-succinimide can be prepared by controlling the molar ratios of the reactants. Thus, for example, if one mole of amine is reacted with one mole of the alkenyl or alkyl substituted succinic anhydride, a predominantly mono-succinimide product will be prepared. If two moles of the succinic anhydride are reacted per mole of polyamine, a bis-succinimide will be prepared.

The preparation of the alkenyl substituted succinic anhydride by reaction with a polyolefin and maleic anhydride has been described, e.g., U.S. Pat. Nos. 3,018,250 and 3,024,195. Reduction of the alkenyl substituted succinic anhydride yields the corresponding alkyl derivative. Polyolefin polymers for reaction with the maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of two or more such olefins such as copolymers of: ethylene and propylene; butylene and isobutylene; etc. Other copolymers include those in which a minor amount of the copolymer monomers, e.g., 1 to 20 mole % is a $C_4$ to $C_8$ nonconjugated diolefin, e.g., a copolymer of isobutylene and butadiene or a copolymer of ethylene, propylene and 1,4-hexadiene; etc.

The olefin polymers contain from about 20 to 300 carbon atoms and preferably from 30 to 150 carbon atoms. An especially preferred polyolefin is polyisobutylene.

The additive complex is generally present in a lubricating oil at a concentration of about 0.05 to about 10 weight percent, preferably about 1.5 to about 6 weight percent.

The overbased calcium hydrocarbyl sulfonates are materials well known in the art and are commercially available materials.

Oil soluble overbased calcium hydrocarbyl sulfonates are made by reacting a calcium base with oil-soluble hydrocarbyl sulfonic acids. Suitable oil-soluble sulfonic acids can be aliphatic or aromatic compounds. Suitable aromatic sulfonic acids are the oil-soluble petroleum sulfonic acids, commonly referred to as "mahogany acids", aryl sulfonic acids, and alkaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have a molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of other suitable sulfonic acids are diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Other suitable oil-soluble sulfonic acids are well described in the art, such as for example U.S. Pat. No. 2,616,604; U.S. Pat. No. 2,626,207; and U.S. Pat. No. 2,767,209, and others.

Some calcium salts of the above compounds have the general formula:

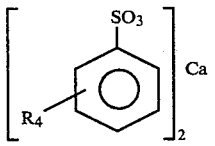

where $R_4$ is alkyl or hydroxy, chloro or bromo hydrocarbyl. In some cases the R group can be made by polymerizing $C_2$–$C_6$ olefins to a molecular weight in the range of about 80 to about 10,000, preferably about 80 to about 1,000, and then attaching said group to a benzene ring by well-known alkylation techniques. $R_4$ can be most any hydrocarbon or substituted hydrocarbon which results in an oil soluble benzene sulfonic acid or salt thereof. $R_4$ can be a low molecular weight alkyl such as isobutyl, nonyl, dodecyl, and the like; an intermediate molecular weight hydrocarbyl such as $C_{15}$–$C_{100}$ polybutene or polypropylene polymers; a higher molecular weight hydrocarbyl such as polyolefin having a number average molecular weight of 10,000, and others. $R_4$ can be substituted with groups such as chlorine, bromine, hydroxy, nitro, or sulfonic acid groups. Also, the benzene ring of the sulfonic acid may have more than one substituent alkyl, or hydroxy, halo, nitro or sulfonic acid alkyl groups.

Nonaromatic sulfonic acids are generally made by the sulfonation of most any aliphatic hydrocarbon such as alkanes, alkenes, and the like. Also, the hydrocarbyl may contain various substitutions which do not interfere with later reactions or end use. One preferred group of non-aromatic sulfonic acids is made by the sulfonation of polymers or copolymers, such as polymerized or copolymerized olefins.

The term polymer olefins as used herein refers to amorphous polymers and copolymers derived from olefinically unsaturated monomers. Such olefin monomers include olefins of the general formula $R_5CH{=}CH_2$, in which $R_5$ comprise aliphatic or cylcoaliphatic radical of from 1 to about 20 carbon atoms, for example, propene, isobutylene, butene-1, 4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have a number average molecular weights from about 36 to about 10,000 or higher, but preferably from about 80 to about 10,000. Of these materials, a preferred group is polypropylene or polybutylene polymers. The olefin may be a copolymer, such as an ethylene propylene copolymer or ethylene-propylene-hexadiene terpolymer, or others.

The preparation of the sulfonic acids is well known. Such sulfonic acids can be prepared by reacting the material to be sulfonated with a suitable sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil soluble sulfonic acid. Overbased sulfonates are commonly made by the reaction of sulfonic acid with calcium bases such as the oxide, hydroxide, or carbonate. Suitable processes for making overbased sulfonates are described in U.S. Pat. Nos. 3,126,340; 3,492,230; 3,524,814 and 3,609,076. The carbonate overbased calcium sulfonates are preferably made from CaO and carbon dioxide in the presence of a promotor such as ethylene diamine or ammonia. However, some overbased sulfonates contain no carbonate.

The term "overbased" as used herein refers to sulfonate materials having a neutralization number greater than about 100, preferably greater than 300, as determined by ASTM D-664 or D-2896.

One of the preferred overbased calcium hydrocarbyl sulfonates comprises overbased alkyl benzene sulfonate comprising about 4 to about 100 carbon atoms in the alkyl group, and having a total base number from about 100 to about 500 and a calcium content in the range of 3% to 18%.

The overbased calcium sulfonate is generally present in a lubricating oil at a concentration of about 0.05% to 5% by weight and preferably about 0.2 to about 2% by weight.

Additive concentrates are also included within the scope of this invention. They usually include from about 90 to 10 weight percent of an oil of lubricating viscosity and are normally formulated to have about 10 times the additive concentration that would be used in the finished lubricating oil composition. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although any oil of lubricating viscosity can be used.

Suitable lubricating oils which can be used to prepare lubricating oil compositions or concentrates of this invention are oils of lubricating viscosity derived from petroleum or synthetic sources. The oils can be paraffinic, naphthenic, halo-substituted hydrocarbons, synthetic esters, polyolefins or combinations thereof. Oils of lubricating viscosity have viscosities in the range from 35 to 50,000 SUS at 100° F., and more usually from about 50 to 10,000 SUS at 100° F.

Other conventional additives which may also be used in combination with the additive combination of this invention include oxidation inhibitors, antifoam agents, rust and corrosion inhibiting agents, viscosity index improvers, pour-point depressants, and the like. These include such compositions as chlorinated wax, benzyl disulfide, sulfurized sperm oils, sulfurized terpene, phosphorus esters such as trihydrocarbon phosphites, metal thiocarbamates such as zinc dioctyldithiocarbamate, polyisobutylene having an average molecular weight of 100,000, etc.

The lubricating oil compositions of the invention are especially useful for lubricating internal combustion engines.

EXAMPLES

The following examples are provided to illustrate the invention. It is to be understood that they are provided for the sake of illustration only and not as a limitation on the scope of the invention.

EXAMPLE 1

Zinc diisopropyl dithiophosphate (A) Diisopropyl Dithiophosphoric Acid

To a two-liter three-necked flask, equipped with a stirrer, nitrogen inlet, dropping funnel and condenser was charged under nitrogen 288.6 g (1.3 moles) $P_2S_5$ and 600 ml of toluene. To this slurry was added 312 g (5.2 moles) of isopropyl alcohol over a period of about seventeen minutes. After stirring for about 30 minutes, the reaction mixture was heated to reflux and maintained at reflux for about 2.5 hours. The clear yellow solution containing the reaction product was decanted off (1050 g) leaving a small amount of black solids; acid No. 241.6; 238.4 mg KOH/g equivalent weight 234.

(B) Zinc Diisopropyl Dithiophosphate

To a two-liter three-necked flask equipped with a stirrer, nitrogen inlet, and a Dean-Stark trap/condenser was added under nitrogen, 526.5 g (2.25 eq.) of diisopropyl dithiophosphoric acid and about 600 ml toluene. To this solution was added 146.5 g zinc oxide (60% eq. excess) at which point the temperature rose to about 74° C. The reaction mixture was heated to reflux and maintained at reflux for about four hours. A total of about 20 ml of water was collected, after which the reaction mixture was further diluted with 200 ml toluene and filtered hot, two times through Celite. The clear filtrate was stripped in a Rotary-Evaorator under full pump vacuum and a water-bath temperature up to 72° C. The product obtained weighed 592.3 g and was a soft, white, crystalline solid-% zinc=14.00, % phosphorus=13.83.

EXAMPLE 2

Formulated oils containing the additives shown in Table I were prepared and tested in a Sequence V-D Test method Phase 9-L (according to candidate test for ASTM). This procedure utilizes a Ford 2.3 liter four cylinder engine. The test method simulates a type of severe field test service characterized by a combination of low speed, low temperature "stop and go" city driving and moderate turnpike operation. The effectiveness of the additives in the oil is measured in terms of the protection provided against valve train wear.

Formulations C, E, and G were prepared by mixing the zinc diisopropyl dithiophosphate and the polyisobutenyl succinimide together at 135° C. until homogeneous. The complex thus formed was added to the oil along with the other components. Formulation B, using n-propyl dithiophosphate was prepared in the same manner. Formulations A, D, and F, were prepared by adding each of the components directly to the oil.

TABLE I

TEST OIL FORMULATIONS (mmoles/kg - except where noted)

| COMPONENTS | FORMULATIONS A | B | C | D[2] | E[2] | F | G |
|---|---|---|---|---|---|---|---|
| Zinc dithiophosphate from sec-butanol and methylisobutylcarbinol | 8.1 | — | — | 9 | — | — | — |
| Zinc di(2-ethylhexyl) dithiophosphate | — | — | — | 9 | 9 | 8.1 | — |
| Zinc (n-propyl) dithiophosphate | — | 8.1 | — | — | — | — | — |
| Zinc diisopropyl dithiophosphate | — | — | 8.1 | — | 9 | — | 8.1 |
| Polyisobutenyl succinimide[1] | 3.5% | 3.5% | 3.5% | 1.75% | 1.75% | 3.5% | 3.5% |
| 300 AV overbased Calcium Alkaryl Sulfonate | 30 | 30 | 30 | 20.4 | 20.4 | 50 | 50 |
| Neutral Calcium Sulfonate | — | — | — | 20.4 | 20.4 | — | |
| Overbased calcium polypropylene phenate (9.25% calcium) | 20 | 20 | 20 | 81.9 | 81.9 | — | — |
| Polymethylacrylate VI improver | 8.5% | 8.5% | 8.5% | — | — | — | — |
| Hydrogenated block copolymer of styrene and isoprene | — | — | — | 20% | 20% | — | — |

[1]The succinimide was prepared by reacting polyisobutenyl succinic anhydride wherein the number average molecular weight of the polyisobutenyl is about 950 and triethylenetetramine in a mole ratio of amine to anhydride of 0.9.
[2]The formulation additionally contains 5.25% of a polyisobutenyl succinimide added separately to the oil.

TABLE II

RESULTS SEQUENCE V-D TEST

| Formulation | Cam Lobe Wear × $10^{-3}$ SF Spec. Max. (2.5) | SF Spec. Avg. (1.0) |
|---|---|---|
| A | 6.70 | 3.90 |
| B | 7.70 | 4.20 |
| C | 1.20 | 1.00 |
| D | 5.8 | 2.1 |
| E | 0.8 | 0.6 |
| F | 7.5 | 4.2 |
| G | 0.90 | 0.80 |

As indicated from the results in Table II the oil formulations C, E, and G containing the complex prepared from zinc diisopropyl dithiophosphate and the succinimide dispersant gave superior wear performance relative to formulation B containing the succinimide complex prepared from zinc di(n-propyl) dithiophosphate and formulations A, D and F containing zinc dithiophosphates of higher alcohols.

What is claimed is:

1. In a lubricating oil composition containing an overbased calcium hydrocarbyl sulfonate, the improvement wherein said lubricating oil composition additionally comprises an effective amount to reduce wear of an oil soluble complex prepared by reacting at about 25° C. to 180° C.

(a) an insoluble metal salt of a diisopropyl dithiophosphoric acid of the formula:

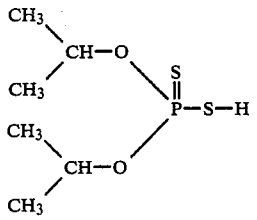

wherein the metal of said metal salt is selected from the group consisting of a Group I metal, a Group II metal, aluminum, tin, cobalt, lead, molybdenum, manganese or nickel; with (b) an oil soluble alkenyl or alkyl mono- or bis-succinimide of the formula

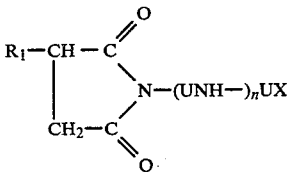

wherein X is amino or a group of the formula

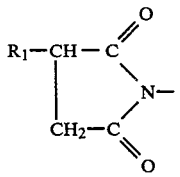

$R_1$ is an alkenyl or alkyl group containing from about 20 to 300 carbon atoms, U is alkylene containing 2 to 6 carbon atoms, n is an integer of from 0 to 6;

wherein the weight of ratio of (b) to (a) is at least in the range of from 3:1 to 10:1.

2. The composition of claim 1 wherein in component (a) of said complex the metal is zinc.

3. The composition of claim 1 wherein the complex is present from about 0.01% to 10% by weight based on the total weight of the lubricating oil composition.

4. The composition of claim 1 wherein in said complex, component (a) is of the formula

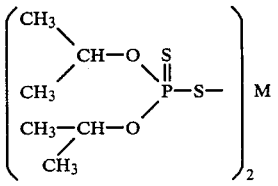

M is a Group II metal; and component (b) is of the formula

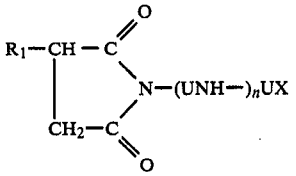

wherein X is amino or a group of the formula

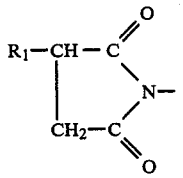

$R_1$ is polyisobutenyl, U is ethylene and n is an integer of from 1 to 4.

5. The composition of claim 4 wherein in component (a) M is zinc.

6. The composition of claim 4 wherein component (a) is zinc diisopropyldithiophosphate and component (b) is of the formula

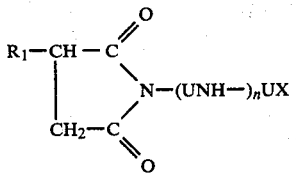

wherein X is amino or

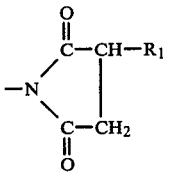

$R_1$ is polyisobutenyl, U is ethylene and n is an integer of from 2 to 4.

7. The composition of claim 6 wherein in component (b) n is 2.

8. A composition comprising a combination of (1) a complex prepared by reacting at about 25° C. to 180° C.

(a) a metal salt of a diisopropyl dithiophosphoric acid of the formula

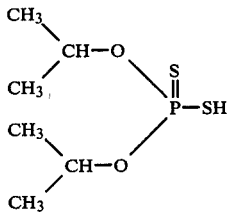

wherein the metal of said metal salt is selected from the group consisting of a Group I metal, a Group II metal, aluminum, tin, cobalt, lead, molybdenum, manganese or nickel; with (b) an oil soluble alkenyl or alkyl mono- or bis-succinimide of the formula:

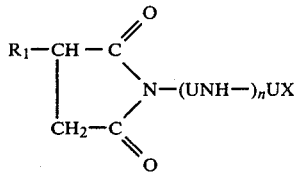

wherein X is amino or a group of the formula

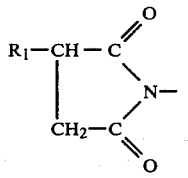

$R_1$ is an alkenyl or alkyl group containing from about 20 to 300 carbon atoms, U is alkylene containing 2 to 6 carbon atoms, n is an integer of from 0 to 6, wherein the weight of ratio of (b) to (a) is at least in the range of from 3:1 to 10:1; and (2) an overbased calcium hydrocarbyl sulfonate, wherein the weight ratio of the complex of component (1) and the overbased calcium salt of component (2) is in the range sufficient to supply from 0.05 to 10% by weight of component (1) and from 0.05 to 5% by weight of component (2) when the additive combination is dissolved in an oil of lubricating viscosity.

9. The composition of claim 8 wherein in component (a) of said complex the metal is zinc.

10. The composition of claim 8 wherein component 1(a) is of the formula

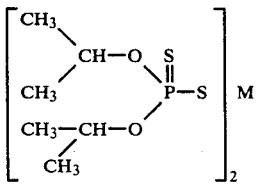

wherein M is a Group II metal; and component 1(b) of the formula

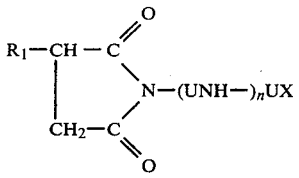

wherein X is amino or a group of the formula

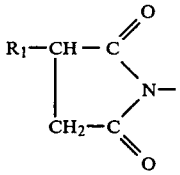

$R_1$ is polyisobutenyl, U is ethylene and n is an integer of from 1 to 4.

11. The composition of claim 10 wherein in component 1(a) of said complex M is zinc.

12. The composition of claim 10 wherein in component (a) is zinc diisopropyl dithiophosphate and component (b) is of the formula

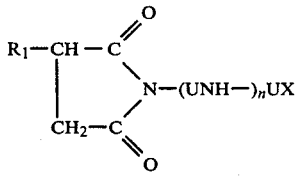

wherein X is amino or

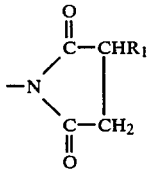

$R_1$ is polyisobutenyl, U is ethylene, and n is an integer of from 2 to 4.

13. The composition of claim 12 wherein in component (b) n is 2.

* * * * *